United States Patent [19]

Koff

[11] 4,193,482

[45] Mar. 18, 1980

[54] GARMENT BAG HANGER ASSEMBLY

[76] Inventor: William Koff, 2100 S. Ocean La., Fort Lauderdale, Fla. 33316

[21] Appl. No.: 34,406

[22] Filed: Apr. 30, 1979

[51] Int. Cl.[2] ..... A45C 13/00

[52] U.S. Cl. ..... 190/41 B; 206/290

[58] Field of Search ..... 190/41 B, 41 Z, 43; 206/285, 286, 287, 289, 290, 291; 312/3, 4, 5, 6

[56] References Cited

U.S. PATENT DOCUMENTS

| | | | |
|---|---|---|---|
| 1,913,021 | 6/1933 | Butterick | 190/41 B |
| 2,214,118 | 9/1940 | Bracken | 190/41 B UX |
| 2,671,706 | 3/1954 | Greengold | 206/286 X |
| 2,918,997 | 12/1959 | Kotkins | 190/41 B |
| 3,139,165 | 6/1964 | Taussig | 190/43 |
| 3,175,658 | 3/1965 | Bierman | 190/43 |

*Primary Examiner*—Donald F. Norton
*Attorney, Agent, or Firm*—Ernest H. Schmidt

[57] ABSTRACT

A soft panelled garment bag supports hangered garments in spaced relation along an interior slide support member having a front-to-back, T-shaped slot opening into which upwardly-extending T-shaped portions of closet rod to garment bag adjustable hangers can be hooked. A zippered front panel of the garment bag is fitted at the inside with a T-shaped keeper adapted to fit into the front of the slide support member to prevent the release of clothes hangers during transport, while at the same time facilitating closure and opening of the garment bag.

10 Claims, 5 Drawing Figures

GARMENT BAG HANGER ASSEMBLY

My invention is directed generally to improvements in garment or travelling bags of the type designed for hangingly supporting suits including coats and trousers, ladies dresses and the like garments on convertible hangers that can be removed and adjusted for hanging on a closet rod, for example, upon completion of a trip.

Convertible garment hangers selectively adjustable for either hanging garments on a closet rod in ordinary fashion or for use in hanging within a garment bag to be supported from above while traveling to minimize folding, crushing, and wrinkling of the clothes while traveling have heretofore been devised. Such garment bag hanger assemblies are considered to be deficient in various respects, however, principally in that the hanging mechanisms are either unduly complex and difficult to adjust or manipulate, or else undependable in operation, particularly in that the hangers had a tendency to fall off the internal support mechanism during packing and during handling for transportation while traveling. It, is accordingly, the principal object of this invention to provide a novel and improved garment bag hanger assembly that obviates these deficiencies of previous comparable garment bags.

A more particular object of the invention is to provide an improved garment bag hanger assembly of the above nature wherein the cooperative hanger slides and hanger slide support member can readily be fabricated of stamped and formed sheet metal for economy and simplicity of construction.

Another object is to provide a garment bag hanger assembly wherein the front opening panel of the garment bag is provided with a keeper receivable in the outer end of the hanger slide support member in the same manner as that of the hangers after all of the clothes supporting hangers have been packed to insure against inadvertent release of the hangers during transport.

Yet another object of the invention is to provide a garment bag hanger assembly of the character described wherein the keeper is so located at the top of the releaseable front panel of the garment bag as to facilitate zipper closure and opening of the bag when inserted in locking position within the hanger slide support member.

Yet another object of the invention is to provide a garment bag hanger assembly of the character described which will be attractive in appearance, inexpensive to manufacture and durable and efficient in use.

Other objects, features and advantages of the invention will be apparent from the following description when read with reference to the accompanying drawings. In the drawings, wherein like reference numerals denote corresponding parts throughout the several views.

Figure 1:
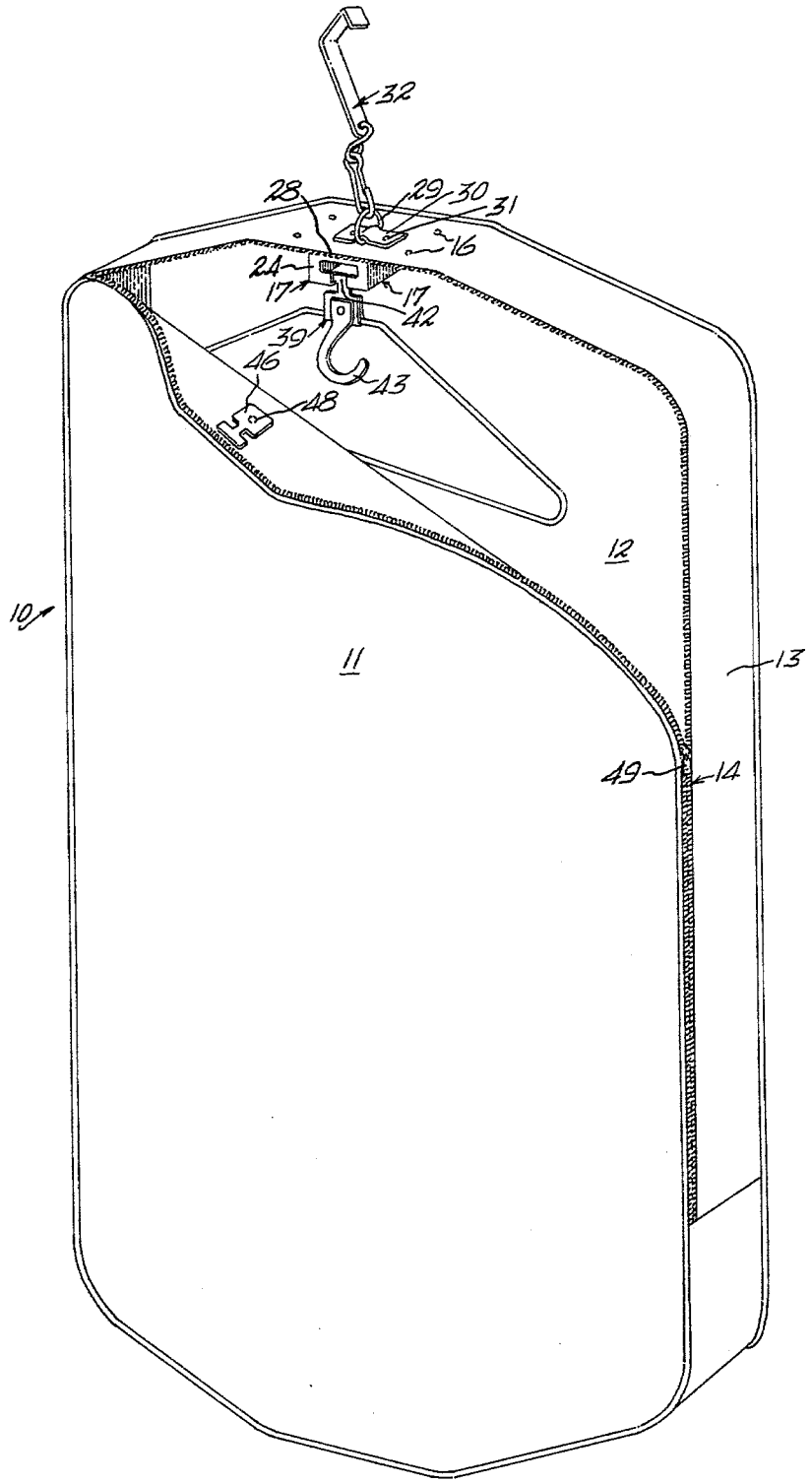
FIG. 1 is a perspective view, as seen from the front and partially open, of a garment bag hanger assembly embodying the invention.

Referring now in detail to the drawings, reference numeral 10 designates, generally, a garment bag the enclosure of which may be of usual construction including elongated flexible front and back panels 11, 12, respectively, and a peripheral gusset 13. Typically, the front panel 11 is separably attached to the front edge of the gusset 13 as by a zipper 14 extending somewhat short of the lower end of the bag to provide for full access to the interior thereof for the packing and removal of clothing.

Figure 2:
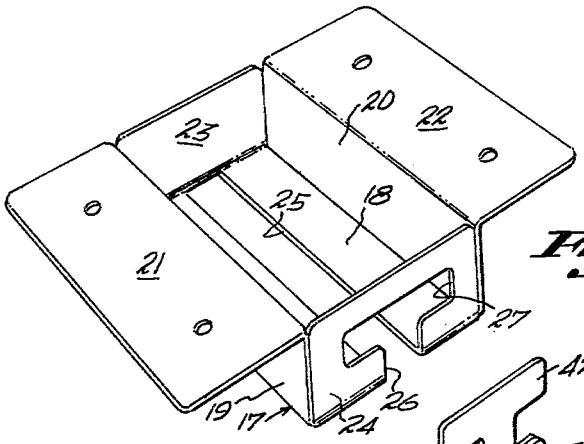
FIG. 2 is a perspective view, as seen from above, of the hanger slide support member, shown separately.
Figure 4:
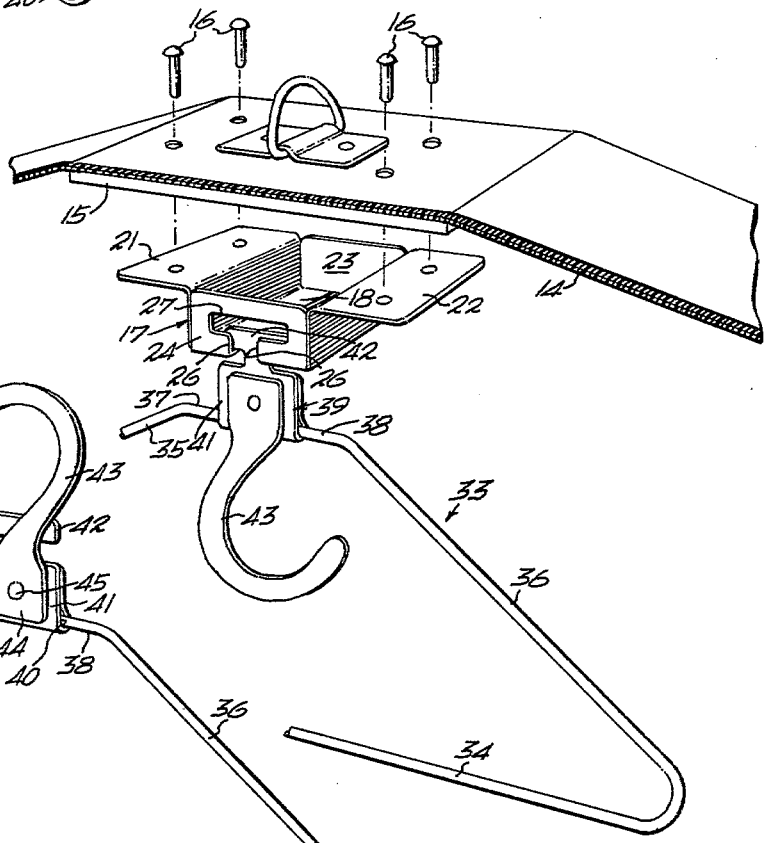
FIG. 4 is an exploded view, in perspective, illustrating assembly of the hanger slide support member to the garment bag, constructional details of a garment bag hanger and its interfitting assembly to the hanger slide support member.

As best illustrated in FIG. 4, the inside of a top central portion of the gusset has fitted thereagainst, for stiffening purposes, a flat, rectangular base member 15, which may be of tempered pressboard, metal or a rigid synthetic plastic material, for example. Fixed against the underside of the base member 15, as by a plurality of rivets 16, is a hanger slide support member 17, which will preferably be fabricated of bent sheet metal. As illustrated in FIG. 2, hanger slide support member 17 comprises a slotted base portion 18, and laterally-opposed, spaced parallel side wall portions 19, 20 the upper ends of which are right-angularly bent into outwardly-projecting coplanar wing portions 21, 22, respectively. The slotted base portion 18 is also integrally formed with upstanding back and front wall portions 23, 24, respectively, the upper ends of which terminate in a substantially common plane defined by wing portions 21, 22. Base portion 18 is provided with a central back-to-front slot 25 which, at its front end, extends partially upwardly of the front wall portion 24, as indicated at 26, to terminate in communication with a substantially rectangular, laterally extending opening 27 therein and defining a T-shaped opening in said front wall portion. As illustrated in FIG. 1, when assembled within the garment bag as is illustrated in FIG. 4 and as is described above, the front wall portion 24 of hanger slide support member 17 extends just short of gusset zipper strip 28 comprising zipper 14.

As means for supporting the garment bag 10 from above, support ring 29 is pivotally secured against a central outside portion of gusset 13 as by clamp plate 30 fixed in place and with respect to base member 15 as by rivets 31. As illustrated in FIG. 1, a hook assembly 32 engageable with support ring 29 may be provided for hanging from any suitable supporting member.

Figure 3:
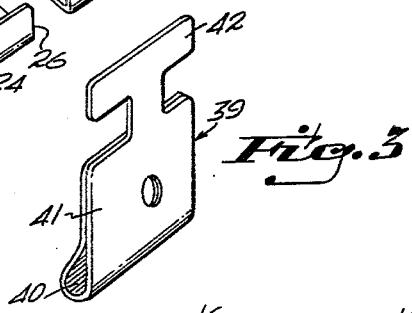
FIG. 3 illustrates a hanger slide member, shown separately and in perspective.
Figure 5:
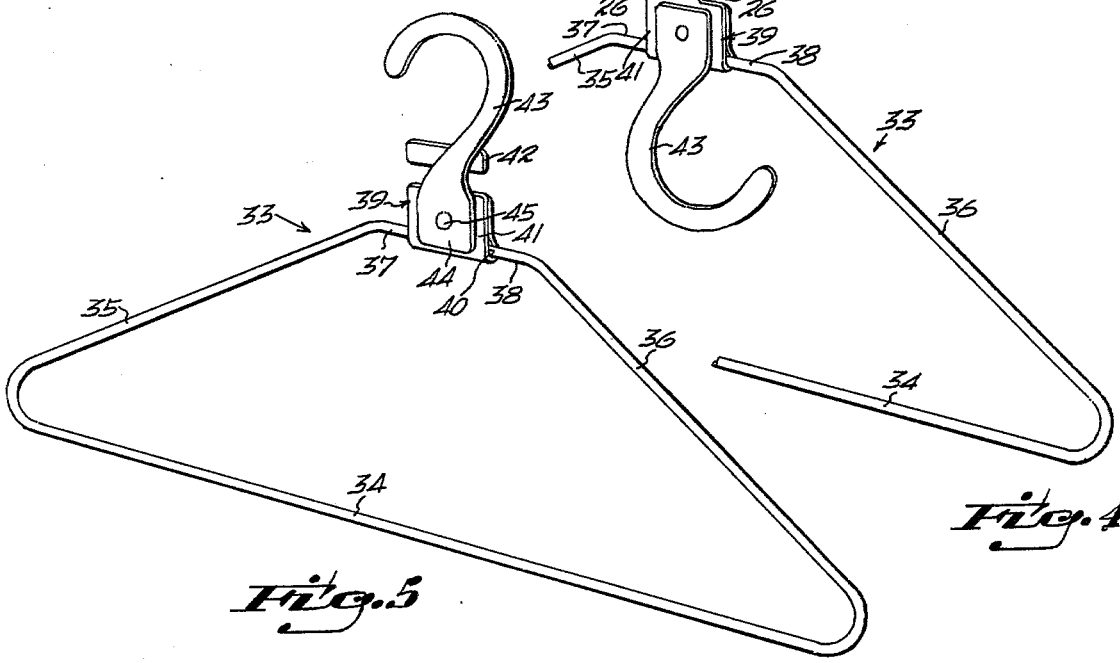
FIG. 5 illustrates, in perspective, a garment bag hanger separated from the garment bag and adjusted for hanging on an ordinary closet rod.

FIG. 5 illustrates one of a plurality of garment bag hangers used with the above described garment bag hanger assembly. The hanger, designated generally by reference numeral 33, comprises a bent wire frame having a horizontal base portion 34 and upwardly and inwardly bent side portions 35, 36 terminating in comparatively short, coaxially-extending end portions 37, 38, respectively, secured in relatively fixed position by a bent sheet metal slide member 39. As illustrated in FIGS. 3 and 5, the bent sheet metal slide member 39 is formed by bending a substantially rectangular piece of sheet metal about garment hanger frame end portions 37, 38 so as to securely clamp said ends within the bight 40 thereof. One of the double-bent side portions 41 of the slide member 39 extends integrally into an upwardly-projecting, T-shaped portion 42 of such peripheral size as to pass freely through the above described T-shaped opening in the front wall portion of the hanger slide support member 17. The garment hanger also comprises a flat, stamped, sheet metal hook member 43 having a substantially rectangular base portion 44. A rivet 45 extending centrally through base portion 44 of hook member 43 and through the double-bent side portions of slide member 39 serves to secure said slide member with respect to bent wire hanger frame 33 while at the same time permitting frictional rotation of said hook member with respect to said slide member. Thus, as illustrated in FIGS. 4 and 5, the hook member 43 can be moved between the downwardly-extending or retracted position (FIG. 4), and the upwardly-extending or independent use position (FIG. 5).

As illustrated in FIG. 1, the front panel 11 of the garment bag has secured thereto at a central portion near the top and as by rivet 48, a flat metal keeper member 46 having an upwardly-extending T-shaped projection of such size as to fit freely through the T-shaped opening in the front wall portion 24 of hanger slide support member 17 in the manner of the T-shaped portion 42 of a hanger 33. The keeper member 46 is so located that when so fitted within the hanger slide support member slot, the garment bag front panel will be supported with the cooperative zipper portions in direct opposition for easy closure with use of the zipper pull tab 49. Thus, when the garment bag is zippered up, the keeper member 46 will be constrained in place within the hanger slide support member 17 at the outer end thereof, thereby preventing such outward movement of the upper end of the front garment bag panel 11 as might otherwise permit one or more of the clothes supporting hangers 33 being released and dropping to the bottom of the garment bag because of agitation during carrying and transport on aircraft, for example.

While I have illustrated and described herein only one form in which my invention can conveniently be embodied in practice, it is to be understood that this form is presented by way of example only and not in a limiting sense. Thus, while the hanger 33 is illustrated herein as being fabricated of wire, it could as well be of a molded synthetic plastic material, with the slide and hook portions integrally formed of either sheet metal or a molded synthetic plastic rotatively secured to the top of the hanger body for selective use of either the slide or hook portions as described above. My invention, in brief, comprises all the embodiments and modifications coming within the scope and spirit of the following claims.

What I claim as new and desire to secure by Letters Patent is:

1. A garment bag hanger assembly comprising, in combination, a garment bag having elongated, flexible front and back panel members, a peripheral gusset interconnecting said front and back panel members and defining therewith an interior garment enclosing chamber, a hanger member for hangingly supporting garments, a hanger slide support member fixed with respect to the inside of a central top portion of said gusset, said hanger slide support member comprising a front-to-back, slotted base portion and an upstanding front wall portion having a through opening communicating with said base portion slot, said through opening comprising a relatively wide upper end portion, said hanger comprising at its upper end a slide member receivable through said front wall portion through opening and defining a first laterally extending portion seatable and slidable along the front-to-back slotted base portion of said hanger slide support member, means for separating an upper portion of said front panel member at its line of juncture with said peripheral gusset to permit access to said interior garment enclosing chamber, a keeper member secured to an inside central portion of said front panel member, said keeper member being receivable through said front wall portion through opening and defining a second laterally-extending portion seatable upon the front-to-back slotted base portion of said panel slide support member.

2. A garment bag hanger assembly as defined in claim 1, wherein said hanger further comprises a rod hook member, said rod hook member being adjustably secured to said slide member for selective positioning between a use position wherein it extends upwardly beyond said slide member for use independently of said slide member, and a non-use position wherein said hook member is below said slide member.

3. A garment bag hanger assembly as defined in claim 1 wherein said through opening communicating with said base portion slot is T-shaped and wherein said first and second laterally-extending portions are of T-shaped configuration.

4. A garment bag hanger assembly as defined in claim 3 wherein said hanger slide support member and said keeper member are fabricated of sheet metal.

5. A garment bag hanger assembly as defined in claim 3 wherein said front panel separating means comprises a slide zipper.

6. A garment bag hanger assembly as defined in claim 5 wherein said keeper is so located on said front panel that when seated upon the front-to back slotted base portion of said panel slide support member said front panel will be supported with the cooperative zipper portions of said slide zipper in direct opposition with use of the zipper pull slide tab.

7. A garment bag hanger assembly as defined in claim 3 wherein said hanger further comprises a rod hook member said rod hook member being adjustably secured to said slide member for selective positioning between a use position wherein it extends upwardly beyond said slide member for use independently of said slide member, and a non-use position wherein said hook member is below said slide member.

8. A garment bag hanger assembly as defined in claim 7 wherein said through opening communicating with said base portion slot is T-shaped and wherein said first and second laterally extending portions are of T-shaped configuration.

9. A garment bag hanger assembly as defined in claim 8 wherein said front panel separating means comprises a slide zipper.

10. A garment bag hanger assembly as defined in claim 9 wherein said hanger slide support member and said keeper member are fabricated of sheet metal.

* * * * *